US005123126A

United States Patent [19]

Vincent

[11] Patent Number: 5,123,126

[45] Date of Patent: Jun. 23, 1992

[54] BED SIDE COMMODE

[76] Inventor: Grover C. Vincent, 111-80 Irvington Hwy., Irvington, Ala. 36544

[21] Appl. No.: 544,188

[22] Filed: Jun. 26, 1990

[51] Int. Cl.[5] ..... A47K 11/06; A47K 11/04

[52] U.S. Cl. ..... 4/480; 4/483

[58] Field of Search ..... 4/480, 483, 254, 479, 4/484, 499; 135/67

[56] References Cited

U.S. PATENT DOCUMENTS 3,829,908 8/1974 Thomas ..... 4/506
4,074,683 2/1978 Di Chiara ..... 135/67
4,571,754 2/1986 England ..... 4/480
4,613,994 9/1986 Oates ..... 4/480
4,869,279 9/1989 Hedges ..... 135/67

*Primary Examiner*—Ernest G. Cusick
*Assistant Examiner*—David J. Walczak
*Attorney, Agent, or Firm*—Gregory M. Friedlander

[57] ABSTRACT

A bed pan mounted into a bracket which bracket is in turn mounted onto a walker frame so that the user may use the walker rails to walk himself between the rails to alleviate the need for the user to walk to the bathroom or move backward to a bathroom seat.

6 Claims, 2 Drawing Sheets

BED SIDE COMMODE

BACKGROUND OF THE INVENTION

1. Prior Art

The invention pertains to aids for the elderly of functionally impaired.

More particularly, the invention pertains to walkers and bedpans.

Historically, the first appendages to weaken beyond use are legs because of various medical reasons and the practical reason that the use of the legs requires both a good sense of balance and strength to support the rest of the body. Walkers are used to supplement the function of the legs by providing a balancing framework with hand rails. The hand rails serve as a support to lean on and as handles to move the walker. With the use of the walker, at least some added mobility is given to the user.

When using the bathroom, a user uses the walker to move to a bathroom. This does not completely resolve the problem since the user, who does not ordinarily have great strength, must raise and lower himself to a bathroom seat. The additional problem exists that a user must move backwards to get in position with a conventional bathroom. A user must then lift himself off of the seat and move back to a resting location.

The present invention provides an unconventional forward approach to the seat.

The alternative, in the prior art, has been to use a bedpan which is usually placed under the user where the user stays. This is uncomfortable and can be unsanitary.

Both methods in the prior art can require the intervention of another person which can cause embarrassment to the user as well as a loss of esteem and frustration from not being able to care for oneself.

2. General Discussion of the Invention

The present invention addresses this problem by providing a movable bathroom utilizing a bracket for holding a bedpan to a frame which is similar in use to a walker. The user, sitting up in a bed, may pull the device towards the bed and lift himself using rails which are a part of the frame. The user can balance himself and walk himself onto the seat using the hand rails. The seat is held in a bracket beneath the hand rails. The height of the seat and rails are adjustable to a comfortable height for the user. The seat bracket is braced so it may hold the full weight of the user.

The frame also supports a padded headrest which is also adjustable by the user. The headrest support not only gives support in the preferred embodiment but also holds a vomit pan since illness may accompany sitting up to use the invention. This headrest is an important aspect of the invention described herein because a standard commode would not provide a means for holding a head rest or a pan.

The bedpan and other pans are removable for easy cleaning. The frame is wider than a standard walker frame in the preferred embodiment to allow the user to comfortably get over the seat.

One object of the invention, therefore, is to provide a free-standing mobile commode or toilet for infirm people.

Another object is to provide a mobile commode with handles to assist moving into place.

Another object is to provide a mobile toilet which can be used while in a standing or near-standing position and alleviates the need for walking to a commode.

Another object is to provide a bathroom device which an elderly or infirm person may use without assistance and without moving backwards to sit down.

These and other objects and advantages of the invention will become better understood hereinafter from a consideration of the specification, with reference to the accompanying drawings forming a part thereof and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DISCUSSION OF THE PREFERRED EMBODIMENT(S)

Figure 1:
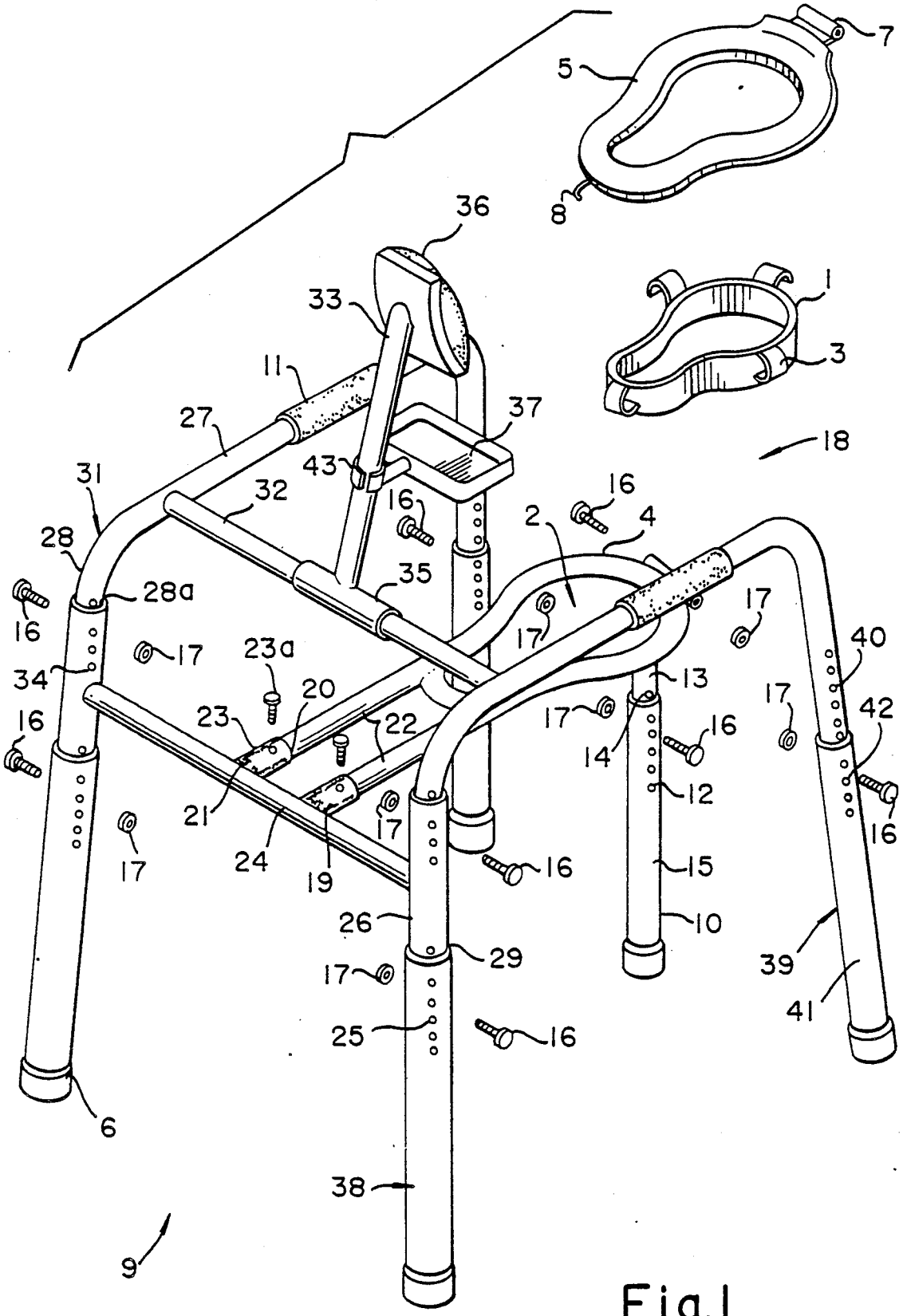
FIG. 1 is an isometric view of the invention.
Figure 2:
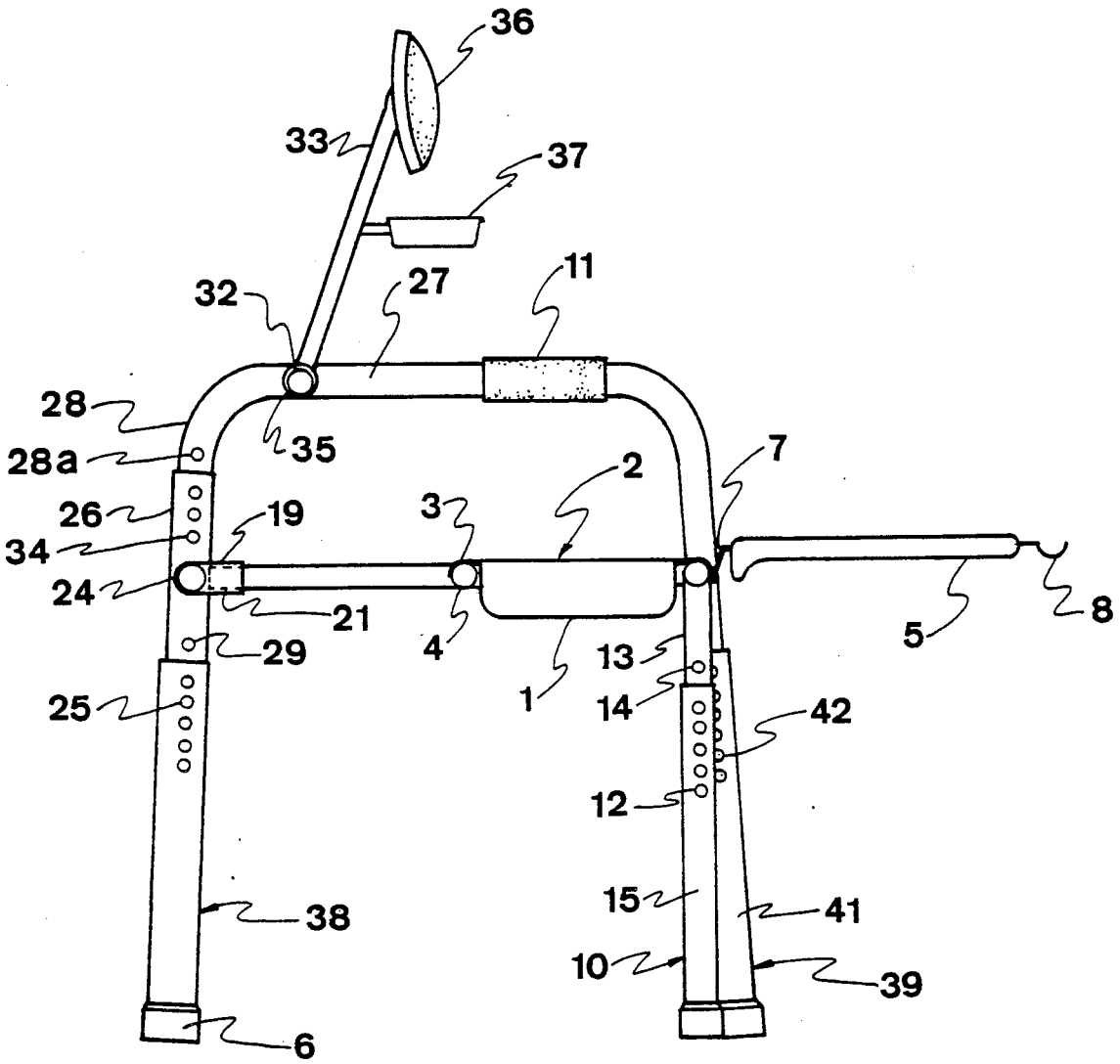
FIG. 2 is the invention of FIG. 1 from a section through the center of the invention shown in FIG. 1.

In the preferred embodiment, as shown in FIG. 1, the device comprises a pan 1 which removably fits within the recess 2, defined by bracket 4. The lip 3 of the pan 1 fits over the edges of the bracket 4 to hold the pan 1 immobile.

A seat 5 is held to bracket 4 by way of hinge 7. Seat 5 may be lowered over lip 3 to hold the pan 1 tightly in place. Clasp 8 holds seat 5 in place when lowered over pan 1. The two mountings of hinge 7 is held in place by pin or bolt 16 which may in turn be held by nut 17. Nut 17 and pin 16 may be pulled so that the seat 5 may be removed for easy cleaning.

The invention shows the use of several pins 16 and nuts 17 for securing the various parts for maximum adjustability and to allow the device to be disassembled for transportation. All of these or any one of them could be replaced with any other fixing means for holding the connections together without any material change in the inventive concept shown herein.

Bracket 4 has a bracket leg 10 which is adjustable in height and mounted at the rear of the bracket 4. Leg 10 comprises an outer tube 15 defining a series of outer tube holes 12, an inner tube 13 defining a series of inner tube holes 14 which inner tube 13 fits tightly within outer tube 15 so that holes 12 and holes 14 come into alignment. Bolt 16 fits through holes 12 and 14 and is held in place by nut 17. In this way, bracket leg 10 is adjustable in height so that it may be the same length as the legs of frame 11 as described in more detail below.

In the preferred embodiment the rear of the bracket 4 is raised so that the user settling on the end of the seat, slides forward into the proper position. Bracket 4 extends forward and inserts within mounting 19. Mounting 19 is a tube defining an opening 20 for receiving the end 21 of bracket arm 22. A bolt hole 23 is available to receive bolt 16 to hold the arm 22 in place. Bolt 16 may be secured by nut 17. This fixing bolt 16 may be replaced by welding or gluing or otherwise permanently bonding bracket 4 to mounting 19 as the distance may be, but need nut be adjustable.

Mounting 19 is attached immovably to horizontal support 24. Horizontal support 24 is mounted on either end of to horizontal support legs 26. Front legs 38 defines a tube which in turn defines a series of upper holes 25. Horizontal support legs 26 fit within the tube defined by front support legs 38. Horizontal support leg defines a series of lower holes 29. Pin 16 fits through holes 29 and 25 to render the height of the bracket 22 adjustable. Nut 17 may be used to secure pin 16.

Rails 27 have front rail legs 28 which are designed to fit within horizontal support legs 26 from the top opening defined by the horizontal support legs 26. Front leg 28 define holes 28*a*. Horizontal support legs 26 define upper holes 34. A pin 16 fits through holes 28*a* and 34 to render the height of the rails 27 adjustable relative to the height of the horizontal support 24 and rails 27 adjustable relative to the bracket 4. Pin 16 may be secured by a bolt 17.

Rails 27 curve towards the back end 18 of the walker designated generally as 9. At the point immediately past the front curve 31, a headrest bar 32 fits between the rails 27. Headrest support 33 is attached by way of a pivot 35 to headrest bar 32 so that the angle of the headrest bar 32 may be adjusted. The pivot 35 is a tube fitting around headrest bar 32.

At the top of headrest support 33 is a headrest 36 which may be padded. A vomit pan 37 may use clip 43 to mount on headrest support 33 a suitable distance from the headrest 36 as determined by the user. The pivot 35 fits tightly around headrest bar 32 so that once adjusted it will remain in place.

At the rear of the walker 18, the rails 27 curve downward towards the floor. The rails 27 terminate with a series of holes 40 in the rail. Rails 27 fit at this rear end into legs 39. A matching series of holes 42 are defined by rear leg 41 so that a pin 16 and bolt 17 may fit to adjust the height of the rear 18 of the invention 9.

In use, the height of horizontal support 24 and therefore bracket 4 is adjusted by adjusting the height of bracket leg 10 using pin 16 and holes 14 and 12; and by simultaneously adjusting the horizontal support legs 26 using holes 29 and 25 a pin 16. Next the height of the railing 27 is set using holes 28*a* and 34 and pins 16 and rear leg height by holes 40 and 42 and pins 16.

The entire commode 9 is preferable made of light material to allow the user to move it into the preferred position. Locking wheels or rubber pads 6 may be used on the ends of legs 15, 38 and 41 to aid in movement or render the device more stable.

Rubber grips 11 or other frictional material may be used along rails 27 in order to allow the user to have a tighter grip.

In practice, the user may start from a sitting position and bring the adjusted device 9 to the bedside or from underneath a tall bed. At that point in time the device which may be foldable in an alternate embodiment is unfolded if necessary. If a bedpan 1 is not in place, one may be added. If necessary, the securing means comprising the seat 5 may be added to hold the bedpan 1 in place. In an alternate embodiment, the bedpan 1 and seat 5 may be of a single piece or may be molded together. This provides a savings in the cost of molding as well as making placement easier. In this type of embodiment, the lip 3 may be the sole securing means and the hinge 7 may be eliminated.

The user can walk himself, using the railings 27, till he is over the pan 1. He can then seat himself over the bedpan 1 and if necessary rest his head on the headrest 36. The vomit pan 37 which is provided can be useful if illness results from the movement. The user can then push himself up using the railings 27 and, if necessary, walk the entire apparatus 9 into a bathroom for cleaning the bed pan 1, utilizing the apparatus 9 as a walker. The commode 9 is slightly wider than an standard walker to allow the bracket 4 to be used and is not as effective as a standard walker. The main purpose of the invention 9 is to prevent walking and its design makes it difficult to walk. To this end, the lip 3 of pan 1 may be clipped onto a standard walker so that the pan may be taken into the bathroom without moving the entire apparatus 9.

Because of the many varying and different embodiments which may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A portable commode for use by a patient who is sitting or standing and which rests on a floor comprising:

a bracket defining a pan opening having two sides, a front and a back;

a support means for supporting said bracket in a horizontal plane spaced from said floor, said support means having a left leg assembly, a right leg assembly and a middle section, the middle section connecting said left leg and right leg assemblies and being attached to the bracket front;

said left leg assembly extending alongside of the bracket and forming an unobstructed space between said bracket and said left leg assembly, said space being sufficiently wide so that the space allows a user to walk himself through the space and over the bracket without turning;

said right leg assembly extending along side of the bracket and forming an unobstructed space between said bracket and said right leg assembly, the space being sufficiently wide so that the space allows a user to move his leg through the space and put his body over the bracket without turning.

2. The commode of claim 1 wherein the commode further comprises at least one handrail attached to the support means.

3. The commode of claim 1 wherein the left and right leg assemblies further comprises front leg sections and rear leg sections positioned such that the front leg sections extend beyond the front of the bracket and the rear leg sections extend beyond the bracket rear; and said commode further comprises:

a right handrail having a handrail front and a handrail back with the handrail front of the right handrail being attached to the front leg section of the right leg assembly and wherein the right handrail back is attached to the rear leg section of the right leg assembly; and a left handrail having a handrail front and a handrail back with the handrail front of the left handrail being attached to the front leg section of the left leg assembly and wherein the left handrail back is attached to the rear leg section of the left leg assembly.

4. The commode of claim 3 wherein said support means further comprises at least one bracket support member attached to the bracket at the bracket rear and providing independent support for the bracket.

5. The commode of claim 4 the left and right leg assemblies and the bracket support member are of adjustable length whereby the bracket is of adjustable height.

6. The commode of claim 4 wherein the handrails are adjustable in height from the point of attachment to the leg assemblies upward so that the height of the handrails is independent of the height of the bracket member and leg assemblies.

* * * * *